US005654036A

United States Patent [19]

Sugiura

[11] Patent Number: 5,654,036

[45] Date of Patent: Aug. 5, 1997

[54] METHOD FOR PAINTING THE SURFACE OF SUBSTRATES

[75] Inventor: Koji Sugiura, Aichi, Japan

[73] Assignee: Tsuyakin Kogyo Co., Ltd., Aichi, Japan

[21] Appl. No.: 448,258

[22] Filed: May 23, 1995

[51] Int. Cl.[6] ..... B05D 1/36; B05D 3/00; B05D 5/00

[52] U.S. Cl. ..... 427/264; 427/353; 427/407.1; 427/416

[58] Field of Search ..... 427/264, 353, 427/407.1, 416, 261

[56] References Cited

U.S. PATENT DOCUMENTS

| | | | |
|---|---|---|---|
| 4,927,666 | 5/1990 | Kawasaki et al. | 427/146 |
| 5,270,078 | 12/1993 | Walker et al. | 427/264 |
| 5,362,703 | 11/1994 | Kawasaki et al. | 503/227 |

*Primary Examiner*—Shrive Beck
*Assistant Examiner*—Bret Chen
*Attorney, Agent, or Firm*—McAulay Fisher Nissen Goldberg & Kiel, LLP

[57] ABSTRACT

Disclosed is a painting method which comprises applying a synthetic resin having an adhesivity and a dye staining property to the surface of a drawn body 10 comprising a metal, glass, ceramics or plastics at 0.1–100 μm thickness, drying the coated synthetic resin to form an accepting layer 11 on the drawn body 10, drawing a character or a pattern on the surface of the accepting layer 11 with a drawing material 12 containing a sublimation dye which is capable of fixing the accepting layer 11 and drying the drawing material 12, wherein the drawing material 12 contains a releasable resin **12*a* which become releasable after drying or a water-soluble resin 12*b*, and after drying, the releasable resin 12*a* is peeled off or the water-soluble resin 12*b*** is dissolved by water and removed.

19 Claims, 1 Drawing Sheet

10 drawn body
11 accepting layer
12 drawing material
12a releasable resin
12b water−soluble resin 10 drawn body
11 accepting layer
12 drawing material
12a releasable resin
12b water-soluble resin

METHOD FOR PAINTING THE SURFACE OF SUBSTRATES

BACKGROUND OF THE INVENTION

I. Field of the Invention

This invention relates to a painting method for painting a character or a pattern on the surface of a drawn body such as a metal, glass, ceramics, plastics, etc. with a drawing material.

II. Description of the Related Art

As a method of applying a picture pattern to pottery, etc., in general, there are methods in which a picture pattern or other coloration is applied to a drawn body with a pigment and after putting glaze on the drawn body, the drawn body is baked, or a picture pattern or other coloration is applied to a glazed surface of fired pottery, etc. with a colorant which melts away at a low temperature and then the material is baked at a low temperature, and so on. However, the above conventional methods each involve problems that baking at a high temperature or a low temperature must be carried out to fix the colorants applied to pottery, etc. thereon so that the procedure is complicated and takes a lot of time.

In order to overcome the above problems, there has been attempted the method in which a transfer paper drawn with a pigment obtained by mixing an inorganic metal oxide(s) with, if necessary, alumina, kaolin, silica, zinc oxide, etc. and calcinating the mixture is prepared and after applying the transfer paper to the surface of pottery, etc., the pottery, etc. are baked at 700° to 800° C. to adhere a picture pattern thereto, However, in this method, there are problems that baking requires several hours and compounding of pigments is difficult.

SUMMARY OF THE INVENTION

An object of the present invention is to provide a painting method capable of painting easily within a short period of time with a low cost without requiring any baking.

A further object of the present invention is to provide a painting method causing no peel off nor blur of a drawing material against surface rubbing without forming a clear coating layer.

As shown in FIG. 1, the present invention relates to a painting method which comprises applying a synthetic resin having an adhesivity and a dye staining property to the surface of a drawn body 10 comprising a metal, glass, ceramics or plastics at 0.1–100 μm thickness, drying the coated synthetic resin to form an accepting layer 11 on the drawn body 10, drawing a character or a pattern on the surface of the accepting layer 11 with a drawing material 12 containing a sublimation dye which is capable of fixing the accepting layer 11 and drying the drawing material 12.

The drawing material 12 contains a releasable resin 12*a* which become releasable after drying or a water-soluble resin 12*b*, or the releasable resin 12*a* is peeled off after drying or the water-soluble resin 12*b* is dissolved by water and removed after drying.

DESCRIPTION OF THE PREFERRED EMBODIMENT

Figure 1:
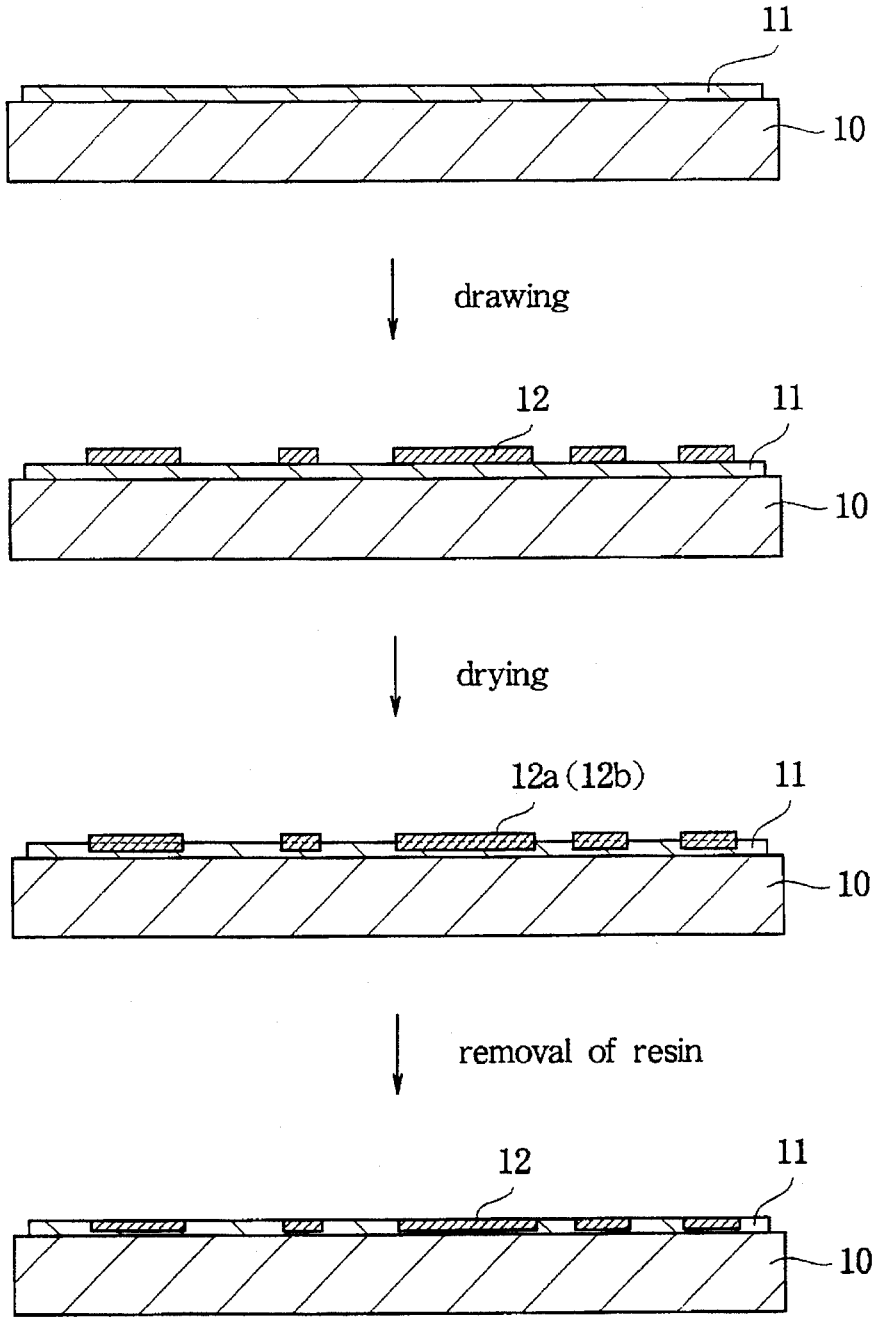
FIG. 1 is sectional views showing the process of painting method of the present invention.

The present invention will be explained in detail below.

The drawn body of the present invention is selected from ① a metal, ② glasses such as an inorganic glass and an organic glass, ③ china such as tableware, ornament, a tile, hand-molded earthenware, etc., or ceramics of porcelain such as European porcelain, Kiyomizuyaki, Setoyaki, etc. or ④ plastics, and the shape thereof is not limited only to a sheet-like material but may be a block-like material or a molded material with unevenness or a processed material.

The synthetic resin which forms an accepting layer applied on the surface of the drawn body is one or more synthetic resins selected from the group consisting of a thermoplastic resin and a thermosetting resin, having an adhesivity to the drawn body and having a dye staining property. Exemplary synthetic resins may be mentioned, for example, a polyester resin, an alkyd resin, a melamine resin, an acrylic resin, a polyamide resin, an epoxy resin, a urethane resin, a vinyl chloride resin, a natural rubber, a synthetic rubber, a phenol resin, a butyral resin, a cellulose resin, a pyrrolidone resin, a silicone resin, a polyvinyl alcohol resin, etc. Of these, a polyester resin, a melamine resin and an acrylic resin are particularly preferred in the point of heat resistance.

Coating of the synthetic resin on the surface of the drawn body is carried out with a thickness of 0.1–100 μm. If the thickness is less than 0.1 μm, fixation of the drawing material is poor, while if it exceeds 100 μm, the accepting layer is peeled off or scratch marks will likely caused at the accepting layer. As the coating method, various coating methods such as spray coating, roller coating, dip coating, spin coating, brush coating, etc. may be mentioned. The coated synthetic resin forms an accepting layer by drying. The drying procedure is carried out under atmospheric pressure at room temperature to about 100° C. depending on the film thickness, the kind of the synthetic resin, etc.

The drawing material of the present invention contains, depending on the finishing method after drying, a sublimation dye and a releasable resin, or a sublimation dye (i.e., a dye having a sublimation property) and a water-soluble resin. The sublimation dye is preferably a dye which sublimates or vaporizes at 60° C. or higher and has a molecular weight in the range of 80 to 4000, particularly in the range of 100 to 1000. The releasable resin is a resin which becomes releasable from the surface of the accepting layer after drying and the water-soluble resin is a resin which is easily dissolved in water and removed from the accepting layer after drying. Exemplary releasable resin may be mentioned, for example, a resin commercially available as a strippable paint including an acrylic resin such as an acryl emulsion, latex, etc., a vinyl series resin such as vinyl acetate, vinyl chloride, etc., a rubber series resin, and a cellulose series resin such as ethyl cellulose, acetyl butyl cellulose, etc. Also, the water-soluble resin may be exemplified by a cellulose series resin, a polyethylene oxide series resin, a polyvinyl series resin, a surfactant, a wax series resin and a rubber series resin.

The sublimation dye is formulated in an amount of 0.1 to 20% by weight and the releasable resin or the water-soluble resin is formulated in an amount of 0.1 to 40% by weight based on 100% by weight of the drawing material, respectively. The drawing material is dispersed or dissolved in an oily solvent or an aqueous solvent to prepare an ink. The ink is preferably made in the form of an emulsion type colors, a crayon, water colors, an oily marker or an aqueous marker. By using the drawing material, a character or a pattern is drawn on the surface of a drawn body by hand written or by making the drawing material a pen, a character or a pattern is drawn on the surface of a drawn body based on image-drawing signals of a computer. When the above drawing material is made an ink, it is preferred to contain the synthetic resin which is used to form the accepting layer in the ink as a binder since the adhesivity of the drawing material is heightened.

After making a picture pattern, the drawing material is dried. Drying is carried out at room temperature but may be carried out at a temperature of not more than 350° C. under heating.

After adhering the accepting layer 11 on the surface of the drawn body 10, a picture pattern is drawn on the surface the accepting layer 11 with a drawing material 12 to fix on the accepting layer 11. After drying the drawing material 12, a releasable resin of the drawing material 12 which forms a convex portion on the accepting layer 11 is peeled off or a water-soluble resin is dissolved by water. Since the excess drawing material 12 on the surface of the accepting layer 11 is removed, the surface of the accepting layer becomes smooth whereby excellent friction resistance of the drawn picture pattern can be obtained.

As described above, according to the present invention, it is constituted that an accepting layer comprising a synthetic resin which has an adhesivity is formed on the surface of a drawn body, a drawing material is fixed thereon and the surface of the accepting layer is made smooth, so that it is not necessary to effect baking and formation of drawing can be done easily within a short period of time with a low cost, which are different from the conventional muffle painting method. Also, even when no clear coating layer is provided at the uppermost layer, no peel off nor blur of a drawing material against surface rubbing is caused whereby clear drawing with durability can be obtained.

Next, the present invention will be explained by referring to Examples, but the scope of the present invention is not limited by the following Examples.

EXAMPLE 1

A large number of white tile plates with a size of 10 cm×10 cm were prepared as a drawn body. A solution containing an acryl emulsion resin having the composition shown below was coated uniformly on the surfaces of these tiles by an air spray gun with a thickness of about 30 μm. The coated solution was dried under atmospheric pressure at about 100° C. for 10 minutes to remove the solvent to form an accepting layer.

| | |
|---|---|
| Acryl emulsion resin (trade name: NIKAZOL 876G, available from NIPPON CARBIDE IND. CO., LTD.) | 75% by weight |
| Ultra-violet ray absorber (trade name: TINUVIN 384, available from CIBA-GEIGY AG) | 20% by weight |
| Antiseptic agent (trade name: PROXEL XL2, available from ZENECA K. K.) | 0.2% by weight |
| Water | 4.8% by weight |
| Total | 100.0% by weight |

On the surface of the above accepting layer was drawn scenery by a paintbrush with an acrylic paint having the following composition, and the acrylic paint was dried at 20° C. for one hour. Then, by using an infrared heating device, the paint was cured by heating at 200° C. for 5 minutes to impregnate into the accepting layer. After cooling the surface of the accepting layer with water or air, the acryl emulsion resin in the dried acrylic paint was peeled off with fingers. The acryl emulsion resin was easily peeled off and the drawn scenery was formed on the tile. This drawn picture pattern had vividness which could not be brought about by glaze, and had high chroma and high fineness. The surface of the accepting layer was smooth and glossy, and had durability against peeling off or blur.

| Acrylic paint | |
|---|---|
| Acryl emulsion resin (trade name: NIKAZOL RX669R, available from NIPPON CARBIDE IND. CO., LTD.) | 70% by weight |
| Wetting agent ethylene glycol | 20% by weight |
| Sublimation dye (trade name: MIKETON POLIESTER YELLOW 3GF, available from MITUI TOATSU DYE INC.) | 5% by weight |
| Antiseptic agent (trade name PROXEL XL2, available from ZENECA K. K. | 1.1% by weight |
| Water | 3.9% by weight |
| Total | 100.0% by weight |

EXAMPLE 2

A large number of white tile plates with a size of 10 cm×10 cm were prepared as a drawn body. A solution containing an acryl emulsion resin having the same composition as in Example 1 was coated uniformly on the surfaces of these tiles by an air spray gun with a thickness of about 30 μm. The coated solution was dried under atmospheric pressure at about 100° C. for 10 minutes to remove the solvent to form an accepting layer.

On the surface of the above accepting layer was drawn still life by a crayon having the following composition with a hand. Then, by using an infrared heating device, the crayon was cured by heating at 200° C. for 5 minutes to impregnate into the accepting layer. After cooling the surface of the accepting layer with water or air, these tiles were dipped in water. The wax in the crayon oozed out on the surface of the accepting layer was dissolved in water. The tile was taken out from water and wiped with a dry cloth, the drawn still life was formed on the tile. This drawn picture pattern had vividness which could not be brought about by glaze, and had high chroma and high fineness. The surface of the accepting layer was smooth and glossy, and had durability against peeling off or blur.

| Crayon | |
|---|---|
| Wax (trade name: HOECHST WAX KST, available from HOECHST JAPAN) | 85% by weight |
| Oil (trade name: EMANON 3299R, available from KAO CORPORATION) | 10% by weight |
| Sublimation dye (trade name: ORIENT RED No. 4. available from ORIENT CHEMICAL IND. LTD.) | 5% by weight |
| Total: | 100.0% by weight |

EXAMPLE 3

A large number of white tile plates with a size of 10 cm×10 cm were prepared as a drawn body. A solution containing an acryl emulsion resin having the same composition as in Example 1 was coated uniformly on the surfaces of these tiles by an air spray gun with a thickness of about 30 μm. The coated solution was dried under atmospheric pressure at about 100° C. for 10 minutes to remove the solvent to form an accepting layer.

On the surface of the above accepting layer was drawn an animal picture pattern by water colors having the following composition with a hand. Then, by using an infrared heating device, the water colors were cured by heating at 200° C. for 5 minutes to impregnate into the accepting layer. After cooling the surface of the accepting layer with water or air, these tiles were dipped in water. The gum arabic in the water colors oozed out on the surface of the accepting layer was dissolved in water. The tile was taken out from water and wiped with a dry cloth, the drawn still life was formed on the tile. This drawn picture pattern had vividness which could not be brought abut by glaze, and had high chroma and high fineness. The surface of the accepting layer was smooth and glossy, and had durability against peeling off or blur.

| Water colors | |
|---|---|
| Gum arabic | 30% by weight |
| Wetting agent ethylene glycol | 20% by weight |
| Wetting agent glycerin | 10% by weight |
| Sublimation dye (trade name: MIKETON POLIESTER BLUE BB, available from MITUI TOATSU DYE INC.) | 10% by weight |
| Antiseptic agent (trade name: AMORDEN FS14D, available from DAIWA CHEMICAL IND. LTD.) | 0.5% by weight |
| Water | 29.5% by weight |
| Total | 100.0% by weight |

EXAMPLE 4

A large number of white tile plates with a size of 10 cm×10 cm were prepared as a drawn body. A solution containing an acryl emulsion resin having the same composition as in Example 1 was coated uniformly on the surfaces of these tiles by an air spray gun with a thickness of about 30 μm. The coated solution was dried under atmospheric pressure at about 100° C. for 10 minutes to remove the solvent to form an accepting layer.

On the surface of the above accepting layer was drawn a character by an oily marker having the following composition with a hand. Then, by using an infrared heating device, the oily marker was cured by heating at 200° C. for 5 minutes to impregnate into the accepting layer. After cooling the surface of the accepting layer with water or air, these tiles were dipped in water, The polyethylene oxide series resin in the oily marker slightly oozed out on the surface of the accepting layer was dissolved in water. The tile was taken out from water and wiped with a dry cloth, the drawn character was formed on the tile. This drawn picture pattern had vividness which could not be brought about by glaze, and had high chroma and high fineness. The surface of the accepting layer was smooth and glossy, and had durability against peeling off or blur.

| Oily marker | |
|---|---|
| Polyethylene oxide series resin (trade name: PAOGEN PP15, available from SANYO CHEMICAL IND. LTD.) | 8% by weight |
| Sublimation dye (trade name: MACROLEX YELLOW 3G, available from BAYER AG) | 8% by weight |

-continued

| Oily marker | |
|---|---|
| Solvent benzene | 44% by weight |
| Solvent xylene | 40% by weight |
| Total | 100.0% by weight |

What is claimed is:

1. A method for painting a surface of a substrate which comprises:

applying a coating of a synthetic resin to the surface, said resin having adhesive properties relative to the surface and being capable of being stained by a dye, the coating having a thickness of from 0.1 to 100 μm;

drying the synthetic resin coating to form an accepting layer;

drawing a character or pattern on the surface of the accepting layer with a drawing material in a solvent comprising a mixture of a sublimation dye capable of impregnating and fixing to the accepting layer and a releasable resin which becomes releasable upon drying;

drying said drawing material to impregnate at least a portion of the dye into the accepting layer; and peeling said releasable resin from said dried drawing material.

2. The method of clam 1 wherein the drawing material is selected from the group consisting of emulsion colors, crayon, water colors, oily markers and aqueous markers.

3. The method of claim 1 wherein the substrate is selected from the group consisting of metal, glass, ceramics, and plastic.

4. The method of claim 1 wherein the synthetic resin is selected from the group consisting of polyester resin, alkyd resin, melamine resin, acrylic resin, polyamide resin, epoxy resin, urethane resin, vinyl chloride resin, natural rubber, synthetic rubber, phenol resin, butyral resin, cellulose resin, pyrrolidone resin, silicone resin and polyvinyl alcohol resin.

5. The method of claim 1 wherein the synthetic resin layer is dried under atmospheric pressure at a temperature from room temperature to 100° C.

6. The method of claim 1 wherein the sublimation dye sublimates at a temperature of at least 60° C. and has a molecular weight in the range from 80 to 4000.

7. The method of claim 6 wherein the molecular weight of the sublimation dye is from 100 to 1000.

8. The method of claim 1 wherein the drawing material comprises from 0.1 to 20% by weight of the sublimation dye and 0.1 to 40% by weight of the releasable resin based on the total weight of the drawing material.

9. The method of claim 1 wherein the drawing material is dispersed or dissolved in an oily solvent or an aqueous solvent.

10. The method of claim 1 wherein the drawing material is dried at a temperature from room temperature to not more than 350° C.

11. A method for painting a surface of a substrate which comprises:

applying a coating of a synthetic resin to the surface, said resin having adhesive properties relative to the surface and being capable of being stained by a dye, the coating having a thickness of from 0.1 to 100 μm;

drying the synthetic resin coating to form an accepting layer;

drawing a character or pattern on the surface of the accepting layer with a drawing material in a solvent comprising a mixture of a sublimation dye capable of impregnating and fixing to the accepting layer and a water soluble resin;

drying said drawing material to impregnate at least a portion of the dye into the accepting layer; and removing the water-soluble resin by washing with water.

12. The method of claim 11 wherein the drawing material is selected from the group consisting of emulsion colors, crayon, water colors, oily markers, and aqueous markers.

13. The method of claim 11 wherein the substrate is selected from the group consisting of metal, glass, ceramics, and plastic.

14. The method of claim 11 wherein the synthetic resin is selected from the group consisting of polyester resin, alkyd resin, melamine resin, acrylic resin, polyamide resin, epoxy resin, urethane resin, vinyl chloride resin, natural robber, synthetic rubber, phenol resin, butyral resin, cellulose resin, pyrrolidone resin, silicone resin and polyvinyl alcohol resin.

15. The method of claim 11 wherein the synthetic resin coating is dried under atmospheric pressure at a temperature from room temperature to 100° C.

16. The method of claim 11, wherein the sublimation dye sublimates at a temperature of at least 60° C. and has a molecular weight in the range from 80 to 4000.

17. The method of claim 16 wherein the molecular weight of the sublimation dye is from 100 to 1000.

18. The method of claim 17 wherein the drawing material comprises from 0.1 to 20% by weight of the sublimation dye and 0.1 to 40% by weight of the water-soluble resin based on the total weight of the drawing material.

19. The method of claim 11 wherein the drawing material dried at a temperature from room temperature to not more than 350° C.

* * * * *